US010194494B2

(12) United States Patent
Joo

(10) Patent No.: US 10,194,494 B2
(45) Date of Patent: Jan. 29, 2019

(54) MICROWAVE COOKING DEVICE

(71) Applicants: MIDEA GROUP CO., LTD., Foshan, Guangdong (CN); GUANGDONG MIDEA KITCHEN APPLIANCES MANUFACTURING CO., LTD., Foshan, Guangdong (CN)

(72) Inventor: Modam Joo, Guangdong (CN)

(73) Assignees: MIDEA GROUP CO., LTD., Foshan, Guangdong (CN); GUANGDONG MIDEA KITCHEN APPLIANCES MANUFACTURING CO., LTD., Foshan, Guangdong (CN)

( * ) Notice: Subject to any disclaimer, the term of this patent is extended or adjusted under 35 U.S.C. 154(b) by 593 days.

(21) Appl. No.: 14/866,171

(22) Filed: Sep. 25, 2015

(65) Prior Publication Data

US 2017/0064777 A1 Mar. 2, 2017

(30) Foreign Application Priority Data

Aug. 27, 2015 (CN) ..... 2015 1 0541299
Aug. 27, 2015 (CN) ..... 2015 2 0662823 U

(51) Int. Cl.
*H05B 6/64* (2006.01)

(52) U.S. Cl.
CPC ..... *H05B 6/6402* (2013.01); *H05B 6/642* (2013.01)

(58) Field of Classification Search
CPC .. H05B 6/6402; H05B 6/6408; H05B 6/6414; H05B 6/642; H05B 6/6426;
(Continued)

(56) References Cited

U.S. PATENT DOCUMENTS 592,718 A * 10/1897 Thompson et al. ..... B60D 1/00 278/58
6,205,618 B1 * 3/2001 Lee ..... E05D 7/1044 16/256

(Continued)

FOREIGN PATENT DOCUMENTS

CA 2463260 A1 1/2005
CN 1504687 A 6/2004

(Continued)

OTHER PUBLICATIONS

Translation of the International Search Report dated May 6, 2016 for corresponding International Application No. PCT/CN2015/090828, filed Sep. 25, 2015.

(Continued)

*Primary Examiner* — Dana Ross
*Assistant Examiner* — Brandon Harvey
(74) *Attorney, Agent, or Firm* — David D. Brush; Westman, Champlin & Koehler, P.A.

(57) ABSTRACT

A microwave cooking device is provided. The microwave cooking device includes a shell defining an air inlet and an air outlet therein; a filter screen disposed at the air outlet; and a ventilation grid assembly. The ventilation grid assembly includes a body defining a through hole therein and disposed on an outer surface of the shell, the through hole being opposite to the filter screen; and a cover plate disposed on the body and moveable between an open position where the through hole is opened by the cover plate and a closed position where the through hole is closed by the cover plate.

16 Claims, 7 Drawing Sheets

(58) Field of Classification Search
CPC ..... Y10S 292/04; E05D 1/06; E05D 3/06; E05D 7/10; E05D 7/1044; E05D 7/1061; E05D 7/12; E05D 2007/126
See application file for complete search history.

(56) References Cited

U.S. PATENT DOCUMENTS

| | | | | |
|---|---|---|---|---|
| 6,660,984 | B1 * | 12/2003 | Jeong | H05B 6/6426 126/21 A |
| 6,897,420 | B2 | 5/2005 | Hoh | |
| 7,098,432 | B2 | 8/2006 | Rew et al. | |
| 7,165,790 | B2 * | 1/2007 | Bella | E05C 19/022 292/302 |
| 2005/0011887 | A1 | 1/2005 | Kim | |
| 2005/0011888 | A1 | 1/2005 | Kim | |
| 2005/0092746 | A1 * | 5/2005 | Song | F24C 15/2042 219/757 |
| 2013/0160410 | A1 * | 6/2013 | Kim | B01D 46/0005 55/385.4 |
| 2014/0137522 | A1 * | 5/2014 | Junior | B65D 43/164 53/492 |

FOREIGN PATENT DOCUMENTS

| | | | |
|---|---|---|---|
| CN | 1576720 | A | 2/2005 |
| CN | 1576721 | A | 2/2005 |
| CN | 1614319 | A | 5/2005 |
| CN | 1661279 | A | 8/2005 |
| CN | 1806148 | A | 7/2006 |
| CN | 101660791 | A | 3/2010 |
| CN | 101701723 | A | 5/2010 |
| CN | 202835722 | U | 3/2013 |
| CN | 204987125 | U | 1/2016 |
| JP | 2010107138 | A | 5/2010 |
| KR | 20050090577 | A | 9/2005 |

OTHER PUBLICATIONS

Partial translation of the International Written Opinion dated May 6, 2016 for corresponding International Application No. PCT/CN2015/090828, filed Sep. 25, 2015.

Partial English translation of the Chinese Office Action dated Feb. 4, 2017 for corresponding Chinese Application No. 201510541299.6, filed Aug. 27, 2015.

* cited by examiner

MICROWAVE COOKING DEVICE

CROSS-REFERENCE TO RELATED APPLICATIONS

This application claims priority to and benefits of the following applications:

1) Chinese Patent Application Serial No. 201510541299.6, filed with the State Intellectual Property Office of P. R. China on Aug. 27, 2015;

2) Chinese Patent Application Serial No. 201520662823.0, filed with the State Intellectual Property Office of P. R. China on Aug. 27, 2015.

The entire contents of the above applications are incorporated herein by reference.

FIELD

The present invention relates to the field of household appliances, and more particularly to a microwave cooking device.

BACKGROUND

An air inlet and an air outlet are formed in a shell of a microwave cooking device performing a function of a range hood in the related art, oil fumes are sucked into the shell via the air inlet of the shell and discharged from the air outlet of the shell, and a filter screen for purifying air is mounted at the air outlet of the shell. After the microwave cooking device is used for a period of time, oil fumes and dirt will be accumulated on the filter screen. In order to achieve better purifying effect, the filter screen needs to be detached periodically for replacement or cleaning.

In order to make the appearance of the microwave cooking device in the related art more beautiful, a ventilation grid is disposed at the air outlet of the shell, and when the filter screen mounted at the air outlet needs to be replaced or cleaned, the entire ventilation grid needs to be first detached, and then the filter screen needs to be detached. Since the ventilation grid is mounted on the shell of the microwave cooking device via a plurality of screws, the detachment and installation of the ventilation grid are time-consuming and labor-consuming, and the screws are easy to loosen, which brings great inconvenience to the user's replacement or cleaning of the filter screen.

SUMMARY

Embodiments of the present invention seek to solve at least one of the problems existing in the related art to at least some extent. Accordingly, the present invention provides a microwave cooking device with a filter screen convenient and easy to replace or clean.

The microwave cooking device according to embodiments of the present invention includes a shell defining an air inlet and an air outlet therein; a filter screen disposed at the air outlet; and a ventilation grid assembly. The ventilation grid assembly includes a body defining a through hole therein and disposed on an outer surface of the shell, the through hole being opposite to the filter screen; and a cover plate disposed on the body and moveable between an open position where the through hole is opened by the cover plate and a closed position where the through hole is closed by the cover plate.

Since the filter screen may be convenient and easy to replace or clean, the microwave cooking device according to embodiments of the present invention has advantages of easy use.

Furthermore, the microwave cooking device according to embodiments of the present invention may further have the following additional technical features.

In an embodiment, the cover plate is pivotably disposed on the body between the open position and the closed position.

In an embodiment, an edge of the through hole is located outside an edge of the filter screen.

In an embodiment, the cover plate defines a positioning hole and a snapping groove therein, and the ventilation grid assembly further includes: a first support disposed at a bottom wall of the through hole; a positioning column defining a first end disposed on the first support and a second end which is a free end and is rotatably fitted within the positioning hole relative to the cover plate; a second support and a third support disposed at the bottom wall of the through hole and spaced apart from each other; and a positioning pin defining a first end disposed on the second support and a second end disposed on the third support, and rotatably snap-fitted within the snapping groove relative to the cover plate.

In an embodiment, the snapping groove has a first snapping face and a second snapping face opposite to each other, and a distance between the first snapping face and the second snapping face is first decreased and then increased in a direction away from an opening of the snapping groove.

In an embodiment, a first snapping member is disposed on the body, and a second snapping member is disposed on the cover plate, snap-fitted with the first snapping member in the closed position and detached from the first snapping member in the open position.

In an embodiment, the first snapping member includes a first elastic snapping arm having a first snapping hook and a second elastic snapping arm having a second snapping hook which define a receiving chamber therebetween, and the second snapping member has a third snapping hook and a fourth snapping hook, in which in the closed position, a part of the second snapping member is received in the receiving chamber, the third snapping hook is snap-fitted with the first snapping hook, and the fourth snapping hook is snap-fitted with the second snapping hook.

In an embodiment, a first part of a front surface of the body is located right above the through hole, opposite to an upper portion of the cover plate in the closed position, and recessed backwardly with respect to a remaining part of the front surface of the body, and the first snapping member is disposed on the first part of the front surface of the body.

In an embodiment, a first protruding rib is disposed at a left side wall of the through hole, a second protruding rib is disposed at a right side wall of the through hole, a front surface of the first protruding rib and a front surface of the second protruding rib are located behind the remaining part of the front surface of the body, in which in the closed position, a left portion of the cover plate is abutted against the first protruding rib and a right portion of the cover plate is abutted against the second protruding rib, and the cover plate is spaced apart from the first part of the front surface of the body in a front-rear direction.

In an embodiment, in the closed position, an upper edge of the first protruding rib and an upper edge of the second protruding rib are adjacent to an upper edge of the cover plate.

In an embodiment, a first limiting groove is formed in a lower portion of the first protruding rib or formed between the first protruding rib and the bottom wall of the through hole, a second limiting groove is formed in a lower portion of the second protruding rib or formed between the second protruding rib and the bottom wall of the through hole, in which in the open position, a first part of the cover plate is engaged within the first limiting groove and abutted against a top wall of the first limiting groove, and a second part of the cover plate is engaged within the second limiting groove and abutted against a top wall of the second limiting groove.

In an embodiment, an upper portion of the first part of the front surface of the body is recessed backwardly with respect to a remaining portion of the first part of the front surface of the body, and defines a receiving space with the cover plate.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

Figure 1:
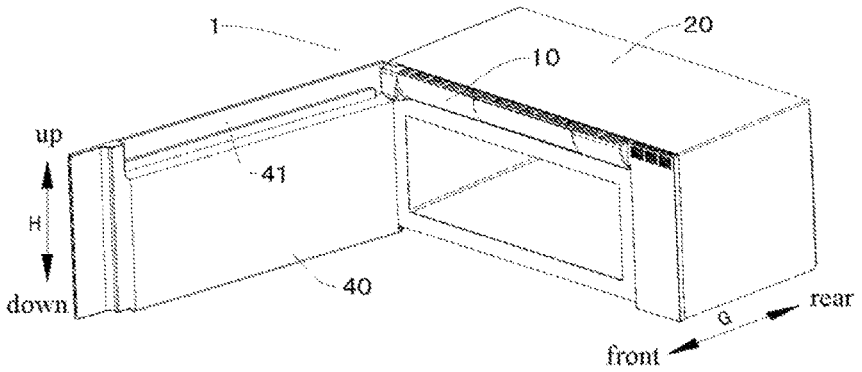
FIG. 1 is a schematic view of a microwave cooking device according to an embodiment of the present invention.
Figure 2:
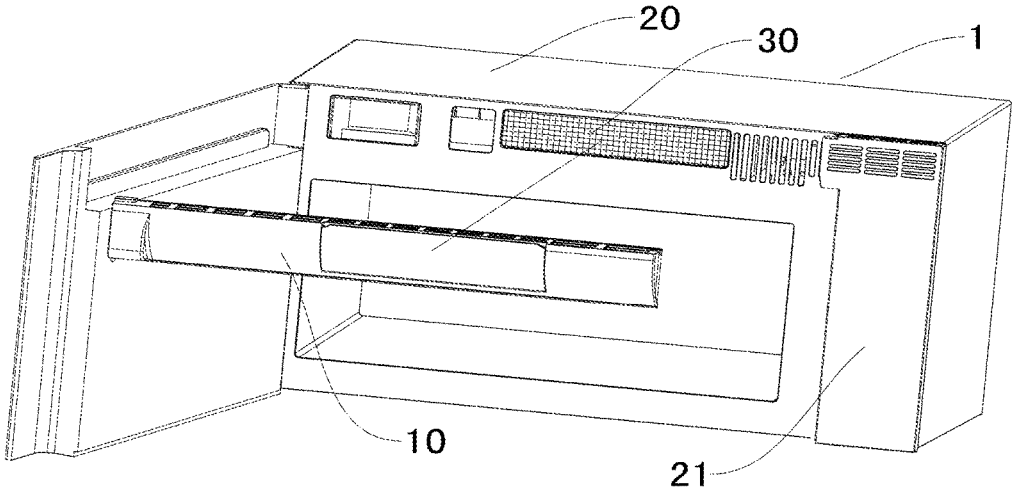
FIG. 2 is an exploded view of a microwave cooking device according to an embodiment of the present invention.

Reference will be made in detail to embodiments of the present invention. The embodiments described herein with reference to drawings are explanatory, illustrative, and used to generally understand the present invention. The embodiments shall not be construed to limit the present invention.

A microwave cooking device 1 according to an embodiment of the present invention will be described below with reference to the drawings. As shown in FIGS. 1-14, the microwave cooking device 1 includes a shell 20, a filter screen 30 and a ventilation grid assembly 10. An air inlet and an air outlet are formed in the shell 20. The filter screen 30 is disposed at the air outlet. The ventilation grid assembly 10 includes a body 101 and a cover plate 102.

A through hole 1011 is formed in the body 101, the body 101 is disposed on an outer surface of the shell 10, and the through hole 1011 is opposite to the filter screen 30. In other words, the body 101, the air outlet and the filter screen 30 are located in the same outer surface of shell 20 (e.g., a front surface 21 of the shell 20). The cover plate 102 is disposed on the body 101 and moveable between an open position where the through hole 1011 is opened by the cover plate 102 and a closed position where the through hole 1011 is closed by the cover plate 102.

The microwave cooking device 1 according to embodiments of the present invention is a microwave cooking device performing a function of a range hood, oil fumes are sucked into the shell 20 via the air inlet of the shell 20 and discharged from the air outlet of the shell 20, and the filter screen 30 for purifying air is mounted at the air outlet of the shell 20. After the microwave cooking device 1 is used for a period of time, oil fumes and dirt will be accumulated on the filter screen 30. In order to achieve better purifying effect, the filter screen 30 needs to be detached periodically for replacement or cleaning.

In order to make the appearance of a microwave cooking device in the related art more beautiful, a ventilation grid is disposed at an air outlet of a shell, and when a filter screen mounted at the air outlet needs to be replaced or cleaned, the entire ventilation grid needs to be first detached, and then the filter screen needs to be detached. Since the ventilation grid is mounted on the shell of the microwave cooking device via a plurality of screws, the detachment and installation of the ventilation grid are time-consuming and labor-consuming, and the screws are easy to loosen, which brings great inconvenience to the user's replacement or cleaning of the filter screen.

With the microwave cooking device 1 according to embodiments of the present invention, since the through hole 1011 opposite to the filter screen 30 is formed in the body 101 of the ventilation grid assembly 10 and the cover plate 102 for opening or closing the through hole 1011 is disposed on the body 101, when the filter screen 30 needs to be replaced or cleaned, the cover plate 102 is moved to the open position so as to expose the through hole 1011 opposite to the filter screen 30, and the filter screen 30 is detached via the through hole 1011. Thus, the filter screen 30 may be conveniently and easily detached without detaching the ventilation grid assembly 10, so as to complete the replacement or cleaning of the filter screen 30.

Afterwards, a new filter screen 30 or the cleaned filter screen 30 may be mounted at the air outlet of the shell 20 via the through hole 1011, and finally the cover plate 102 is moved to the closed position so as to complete the whole replacement or cleaning process.

Since the filter screen 30 may be convenient and easy to replace or clean, the microwave cooking device 1 according to embodiments of the present invention has advantages of reasonable structure, easy use and so on.

As shown in FIGS. 1-14, in some embodiments, the microwave cooking device 1 includes a shell 20, a filter screen 30 and a ventilation grid assembly 10. An air inlet is formed in a lower surface of the shell 20, an air outlet is formed in a front surface 21 of the shell 20, and the filter screen 30 is disposed at the air outlet. In order to discharge air in the shell 20 from the air outlet more easily, a plurality of air vents 1015 are formed in the ventilation grid assembly 10.

The ventilation grid assembly 10 includes a body 101 and a cover plate 102. The body 101 is disposed on the front surface 21 of the shell 20, and a through hole 1011 is formed in the body 101 and opposite to the filter screen 30. In other words, the through hole 1011 runs through the body 101 in a front-rear direction, and has a bottom wall 10111, a left side wall 10112, a right side wall and a top wall. The front surface 21 of the shell 20 refers to a surface of the shell 20 adjacent to (facing) a user, and the front-rear direction is as indicated by an arrow G in FIG. 1.

Advantageously, an edge of the through hole 1011 is located outside an edge of the filter screen 30. In other words, a projection of the edge of the through hole 1011 in the front surface 21 of the shell 20 is located outside a projection of the filter screen 30 in the front surface 21 of the shell 20. That is, the projection of the filter screen 30 in the front surface 21 of the shell 20 is located inside the projection of the edge of the through hole 1011 in the front surface 21 of the shell 20. Thus, the filter screen 30 may be conveniently and easily detached or mounted. More advantageously, the size of the through hole 1011 is slightly greater than that of the filter screen 30.

The cover plate 102 is pivotably disposed on the body 101 between the open position where the through hole 1011 is opened by the cover plate 102 and the closed position where the through hole 1011 is closed by the cover plate 102.

Figure 8:
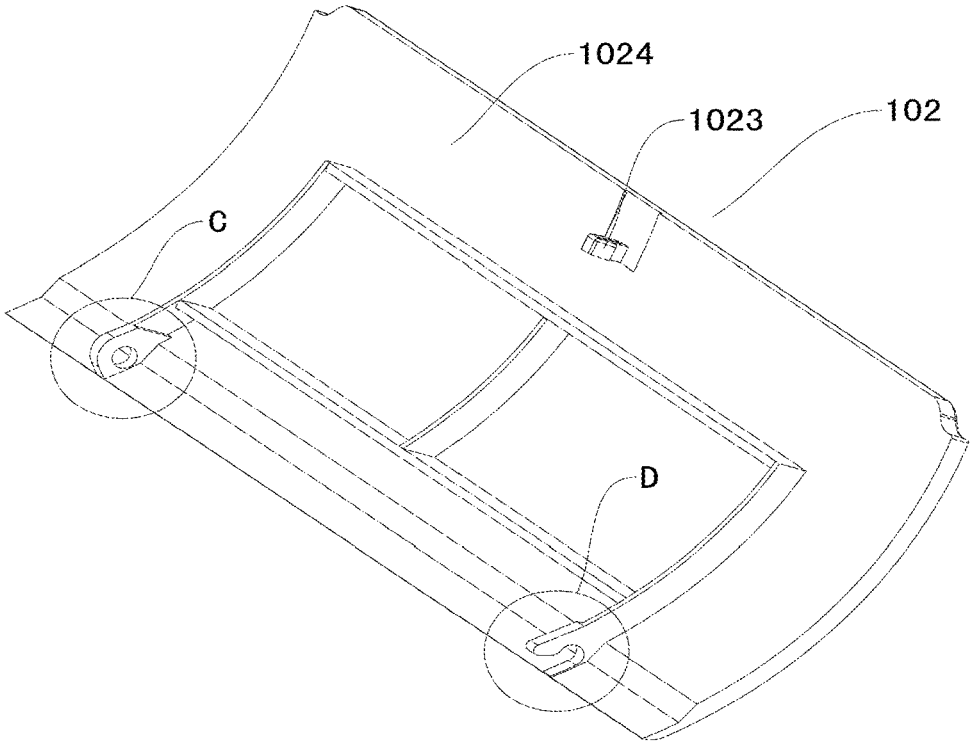
FIG. 8 is a schematic view of a cover plate of a ventilation grid assembly of a microwave cooking device according to an embodiment of the present invention.
Figure 9:
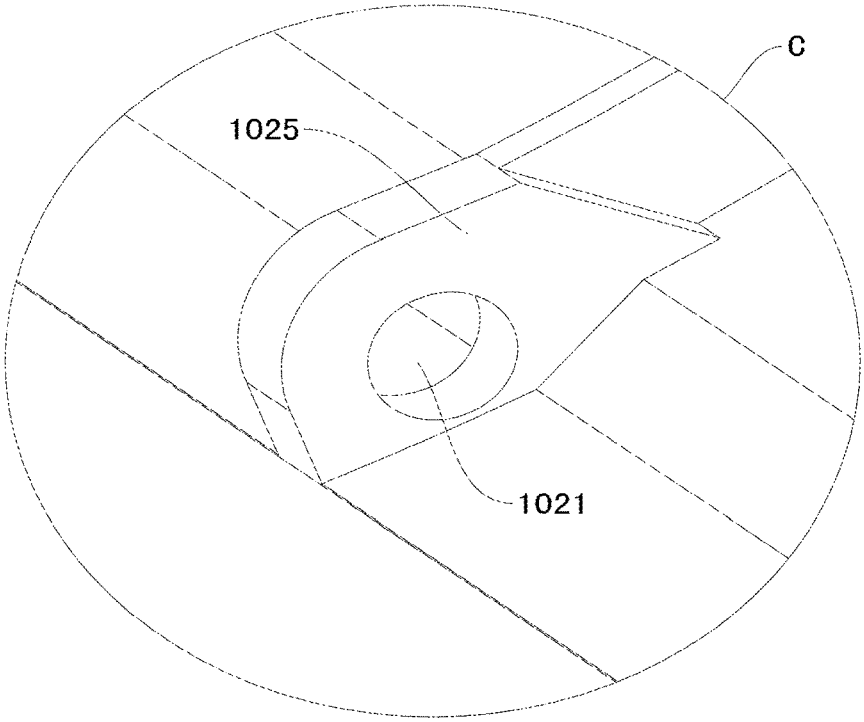
FIG. 9 is an enlarged view of region C in FIG. 8.
Figure 10:
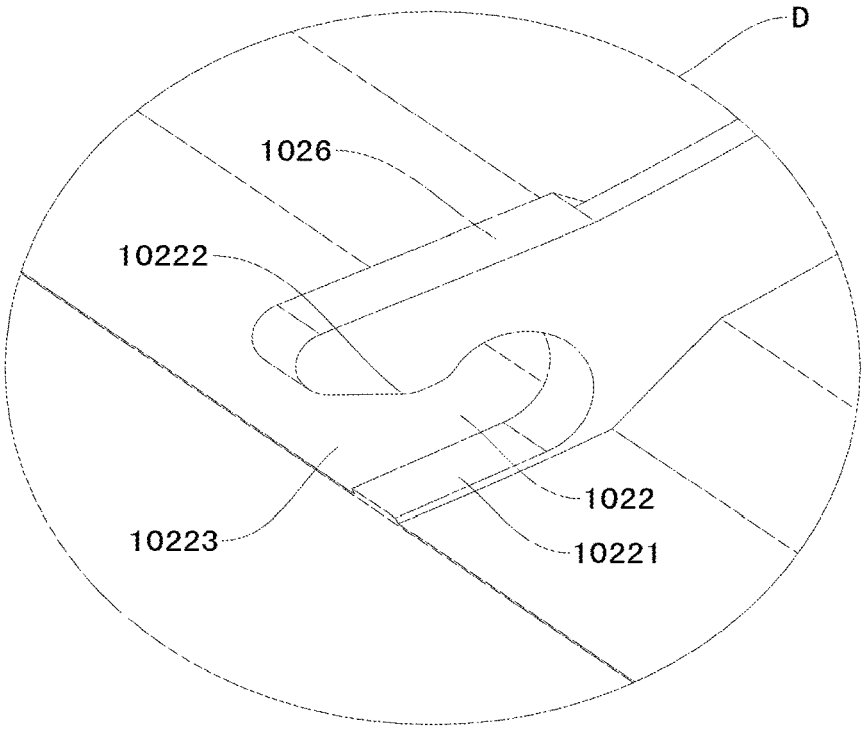
FIG. 10 is an enlarged view of region D in FIG. 8.
Figure 11:
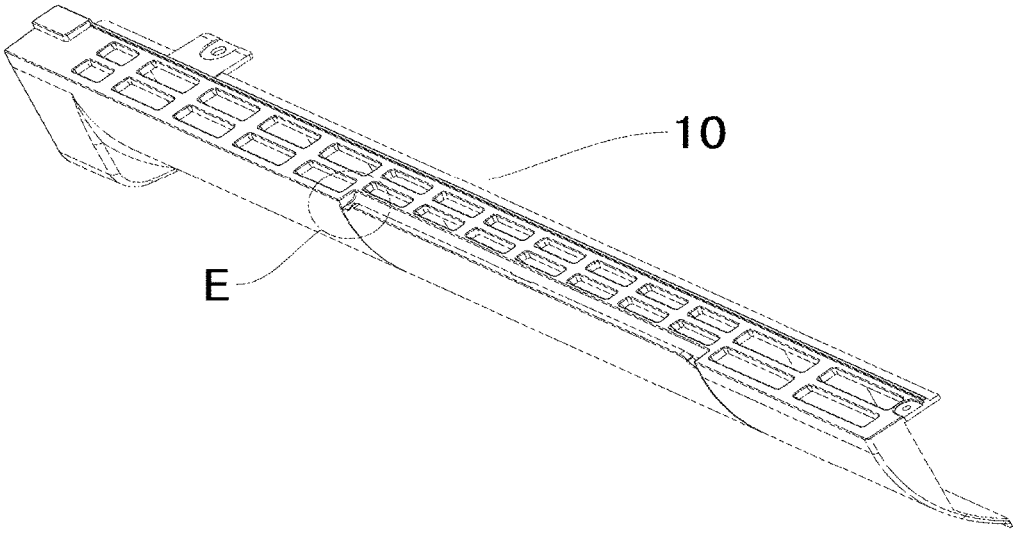
FIG. 11 is a schematic view of a ventilation grid assembly of a microwave cooking device according to an embodiment of the present invention, in which a cover plate of the ventilation grid assembly is in a closed position.

As shown in FIGS. 8-10, in an embodiment, a positioning hole 1021 and a snapping groove 1022 are formed in the cover plate 102. Specifically, a first flat plate 1025 and a second flat plate 1026 are disposed on a first surface 1024 of the cover plate 102, which is a rear surface of the cover plate 102 when the cover plate 102 is in the closed position. The positioning hole 1021 is formed in the first flat plate 1025, and the snapping groove 1022 is formed in the second flat plate 1026. Advantageously, the positioning hole 1021 and the snapping groove 1022 are adjacent to a lower edge of the cover plate 102.

As shown in FIGS. 3 and 5-7, the ventilation grid assembly 10 further includes a positioning column 1032, a positioning pin 1035, a first support 1031, a second support 1033 and a third support 1034. The first support 1031 is disposed at a bottom wall 10111 of the through hole 1011. A first end of the positioning column 1032 is disposed on the first support 1031, and a second end of the positioning column 1032 is a free end and is rotatably fitted within the positioning hole 1021 relative to the cover plate 102, such that the cover plate 102 is pivotably disposed on the body 101 between the open position and the closed position. In other words, the positioning column 1032 is static relative to the body 101, and the cover plate 102 is rotatable relative to the positioning column 1032.

The second support 1033 and the third support 1034 are disposed at the bottom wall 10111 of the through hole 1011 and spaced apart from each other. A first end of the positioning pin 1035 is disposed on the second support 1033, a second end of the positioning pin 1035 is disposed on the third support 1034, and the positioning pin 1035 is rotatably snap-fitted within the snapping groove 1022 relative to the cover plate 102, such that the cover plate 102 is pivotably disposed on the body 101 between the open position and the closed position. In other words, the positioning pin 1035 is static relative to the body 101, and the cover plate 102 is rotatable relative to the positioning pin 1035.

When the cover plate 102 needs to be mounted, the positioning column 1032 is first inserted into the positioning hole 1021, and then the positioning pin 1035 is snap-fitted within the snapping groove 1022, such that the cover plate 102 is rapidly and stably mounted onto the body 101. Moreover, since the first support 1031, the second support 1033 and the third support 1034 are disposed at the bottom wall 10111 of the through hole 1011, a front surface 1027 of the cover plate 102 is flush with a front surface 1016 of the body 101, such that the appearance of the ventilation grid assembly 10 and the microwave cooking device 1 may be more beautiful. In this embodiment, an upper edge of the cover plate 102 is flush with an upper edge of the through hole 1011.

As shown in FIG. 10, advantageously, the snapping groove 1022 has a first snapping face 10221 and a second snapping face 10222 opposite to each other, and a distance between the first snapping face 10221 and the second snapping face 10222 is first decreased and then increased in a direction away from an opening 10223 of the snapping groove 1022. In other words, the width of the snapping groove 1022 is first decreased and then increased in the direction away from an opening 10223 of the snapping groove 1022. Thus, not only may the positioning pin 1035 be conveniently and easily inserted into the snapping groove 1022, but also it is difficult to detach the positioning pin 1035 from the snapping groove 1022, such that the cover plate 102 may be mounted onto the body 101 more stably.

Advantageously, as shown in FIG. 10, the first snapping face 10221 may be a plane, and the second snapping face 10222 may be a V-shaped face.

Figure 3:
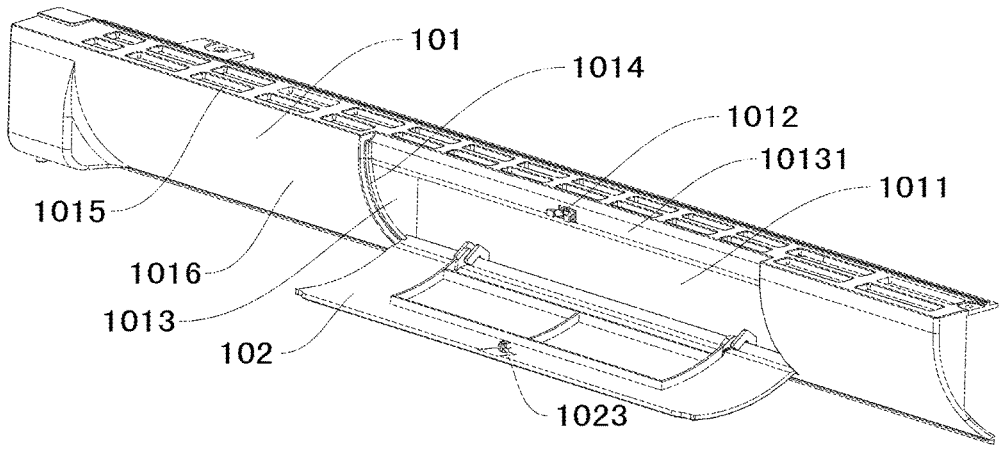
FIG. 3 is a schematic view of a ventilation grid assembly of a microwave cooking device according to an embodiment of the present invention, in which a cover plate of the ventilation grid assembly is in an open position.
Figure 4:
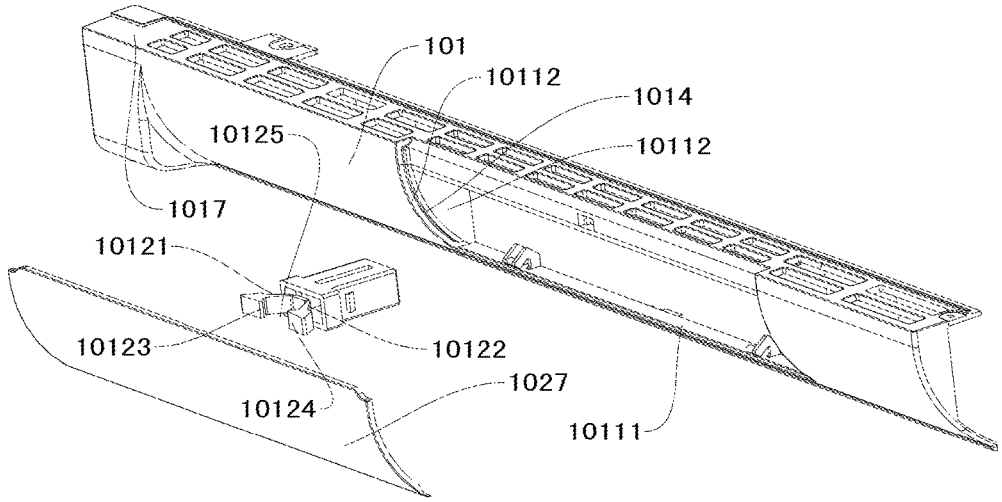
FIG. 4 is an exploded view of a ventilation grid assembly of a microwave cooking device according to an embodiment of the present invention.

As shown in FIGS. 3-4, in some examples, a first snapping member 1012 is disposed on the body 101, and a second snapping member 1023 is disposed on the cover plate 102. The second snapping member 1023 is snap-fitted with the first snapping member 1012 in the closed position, and detached from the first snapping member 1012 in the open position. Thus, when the microwave cooking device 1 is normally used, i.e. the filter screen 30 does not need to be replaced or cleaned, the cover plate 102 may be kept in the closed position.

Specifically, as shown in FIG. 4, the first snapping member 1012 includes a first elastic snapping arm 10121 and a second elastic snapping arm 10122, the first elastic snapping arm 10121 has a first snapping hook 10123, the second elastic snapping arm 10122 has a second snapping hook 10124, and a receiving chamber 10125 is defined between the first elastic snapping arm 10121 and the second elastic snapping arm 10122. The second snapping member 1023 has a third snapping hook and a fourth snapping hook. In the closed position, a part of the second snapping member 1023 is received in the receiving chamber 10125, the third snapping hook is snap-fitted with the first snapping hook 10123, and the fourth snapping hook is snap-fitted with the second snapping hook 10124. Thus, the structure of the ventilation grid assembly 10 may be more reasonable. Moreover, by providing the first elastic snapping arm 10121 and the second elastic snapping arm 10122, the second snapping member 1023 may be more easily detached from the first snapping member 1012, such that the cover plate 102 may be more easily moved from the closed position to the open position.

Figure 5:
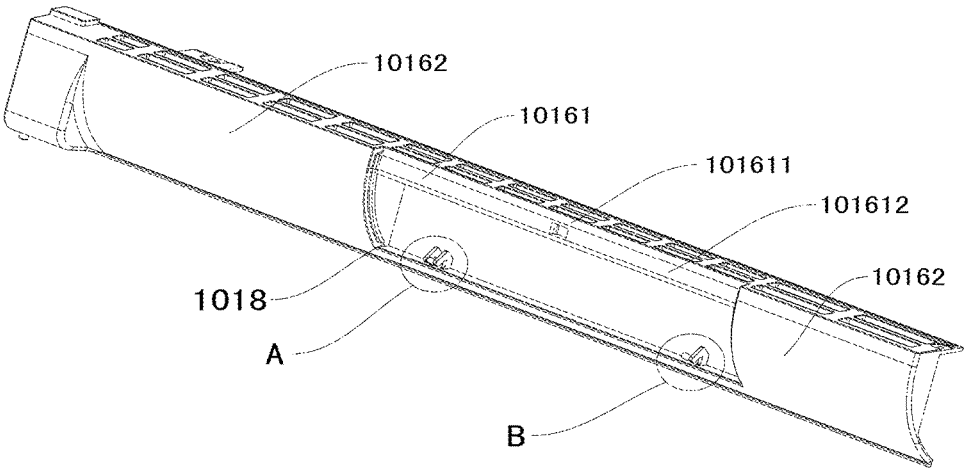
FIG. 5 is a schematic view of a body of a ventilation grid assembly of a microwave cooking device according to an embodiment of the present invention.

As shown in FIGS. 3-5, in an example, a first part 10161 of a front surface 1016 of the body 101 is located right above the through hole 1011, and opposite to an upper portion of the cover plate 102 in the closed position. The first part 10161 of the front surface 1016 of the body 101 is recessed backwardly with respect to a remaining part 10162 of the front surface 1016 of the body 101, and the first snapping member 1012 is disposed on the first part 10161 of the front surface 1016 of the body 101. Thus, the structure of the ventilation grid assembly 10 and the microwave cooking device 1 may be more reasonable. Moreover, since the first part 10161 of the front surface 1016 of the body 101 is recessed backwardly with respect to the remaining part 10162 of the front surface 1016 of the body 101, a front surface of the upper portion of the cover plate 102 may be flush with the remaining part 10162 of the front surface 1016 of the body 101.

In other words, as shown in FIG. 3, a recess 1013 with an open upper end is formed in the front surface 1016 of the body 101, and the through hole 1011 is formed in a rear wall 10131 of the recess 1013. Since the recess 1013 is formed in the front surface 1016 of the body 101, the recess 1013 may be used to receive the cover plate 102, such that the front surface 1027 of the cover plate 102 may be flush with the front surface 1016 of the body 101 when the cover plate 102 is in the closed position. Thus, the appearance of the microwave cooking device 1 may be more beautiful.

As shown in FIGS. 3-5 and 12, in another example, a first protruding rib 1014 is disposed at a left side wall 10112 of the through hole 1011, a second protruding rib (not shown) is disposed at a right side wall of the through hole 1011, a front surface of the first protruding rib 1014 and a front surface of the second protruding rib are located behind the remaining part 10162 of the front surface 1016 of the body 101. In the closed position, a left portion of the cover plate 102 is abutted against the first protruding rib 1014 and a right portion of the cover plate 102 is abutted against the second protruding rib, and the cover plate 102 is spaced apart from the first part 10161 of the front surface 1016 of the body 101 in a front-rear direction.

In other words, there is a gap between the first part 10161 of the front surface 1016 of the body 101 and a portion of the cover plate 102 between the left and right portions of the cover plate 102. When the cover plate 102 needs to be opened, the portion (e.g., a middle portion of the cover plate 102) of the cover plate 102 between the left and right portions of the cover plate 102 is pressed backwardly, such that the cover plate 102 is elastically deformed to produce an elastic force. Then, the cover plate 102 is released, and recovered to its original shape. Under the elastic force of the cover plate 102, the first snapping member 1012 is detached from the second snapping member 1023 so as to open the cover plate 102.

Since the front surface of the first protruding rib 1014 and the front surface of the second protruding rib are located behind the remaining part 10162 of the front surface 1016 of the body 101, when the cover plate 102 is abutted against the first protruding rib 1014 and the second protruding rib, the front surface 1027 of the cover plate 102 may be flush with the remaining part 10162 of the front surface 1016 of the body 101. Advantageously, the cover plate 102 may be a plastic component, i.e. the cover plate 102 may be made of a plastic material.

Figure 12:
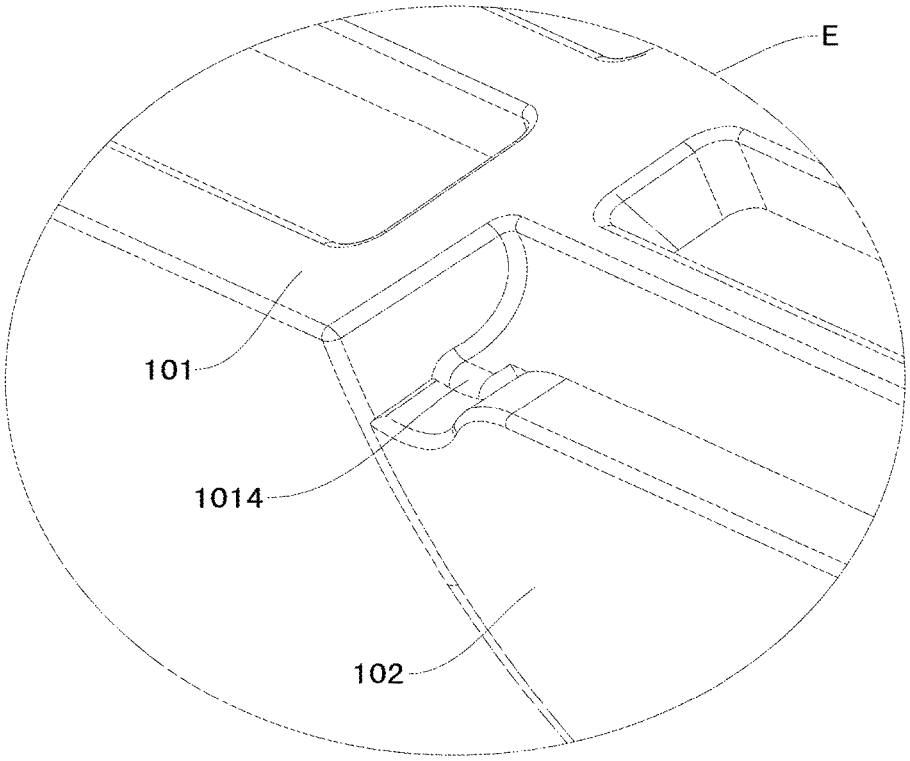
FIG. 12 is an enlarged view of region E in FIG. 11.
Figure 13:
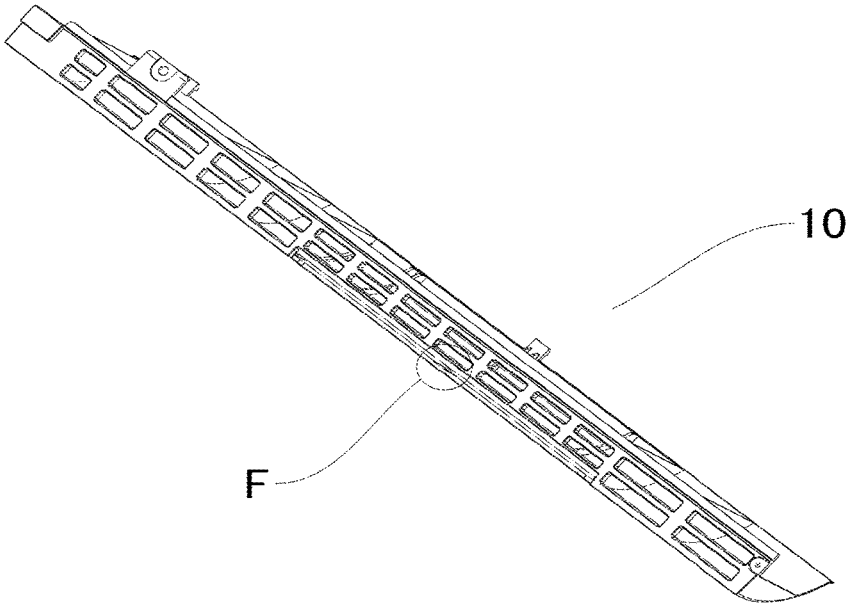
FIG. 13 is a schematic view of a ventilation grid assembly of a microwave cooking device according to an embodiment of the present invention, in which a cover plate of the ventilation grid assembly is in a closed position.
Figure 14:
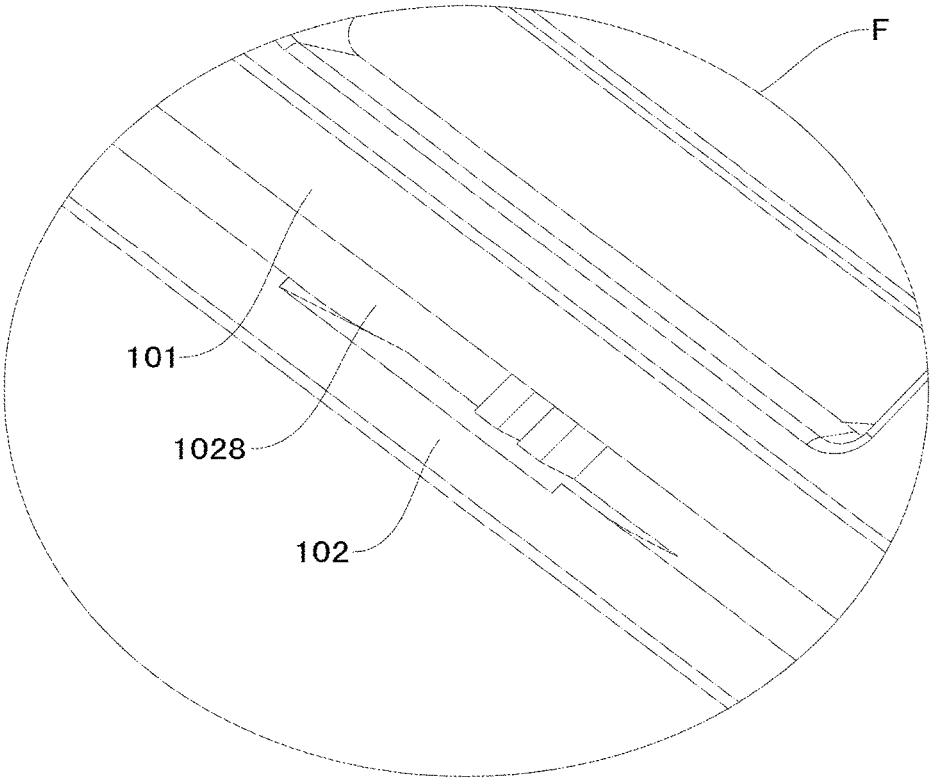
FIG. 14 is an enlarged view of region F in FIG. 13.

As shown in FIG. 12, in the closed position, an upper edge of the first protruding rib 1014 and an upper edge of the second protruding rib are adjacent to an upper edge of the cover plate 102. In other words, as shown in FIGS. 3-5, the upper edge of the first protruding rib 1014 and the upper edge of the second protruding rib are adjacent to an upper surface 1017 of the body 101. Thus, when the portion of the cover plate 102 between the left and right portions of the cover plate 102 is pressed backwardly, the cover plate 102 may be more elastically deformed to produce a larger elastic force, such that the first snapping member 1012 may be more effectively and easily detached from the second snapping member 1023 so as to open the cover plate 102.

As shown in FIGS. 3-4, in a specific example, a first limiting groove 1018 is formed in a lower portion of the first protruding rib 1014 or formed between the first protruding rib 1014 and the bottom wall 10111 of the through hole 1011, and a second limiting groove is formed in a lower portion of the second protruding rib or formed between the second protruding rib and the bottom wall 10111 of the through hole 1011.

In the open position, a first part of the cover plate 102 is engaged within the first limiting groove 1018 and abutted against a top wall of the first limiting groove 1018, and a second part of the cover plate 102 is engaged within the second limiting groove and abutted against a top wall of the second limiting groove. Thus, the cover plate 102 cannot continue to pivot, such that an angle of the cover plate 102 when being opened may be fixed, i.e. the cover plate 102 in the open position may be kept in a fixed position.

Figure 6:
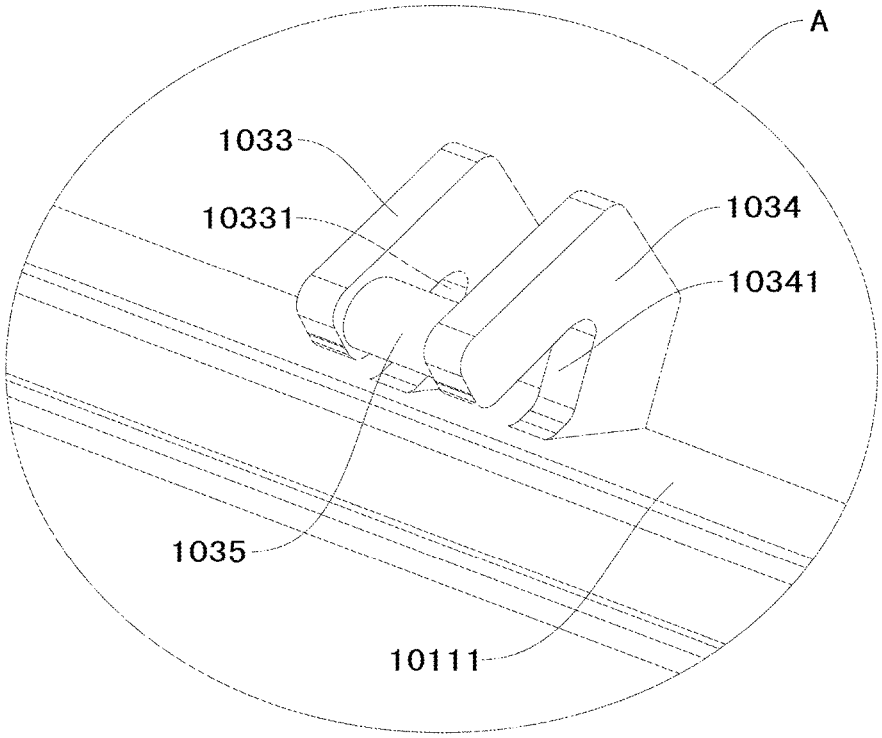
FIG. 6 is an enlarged view of region A in FIG. 5.
Figure 7:
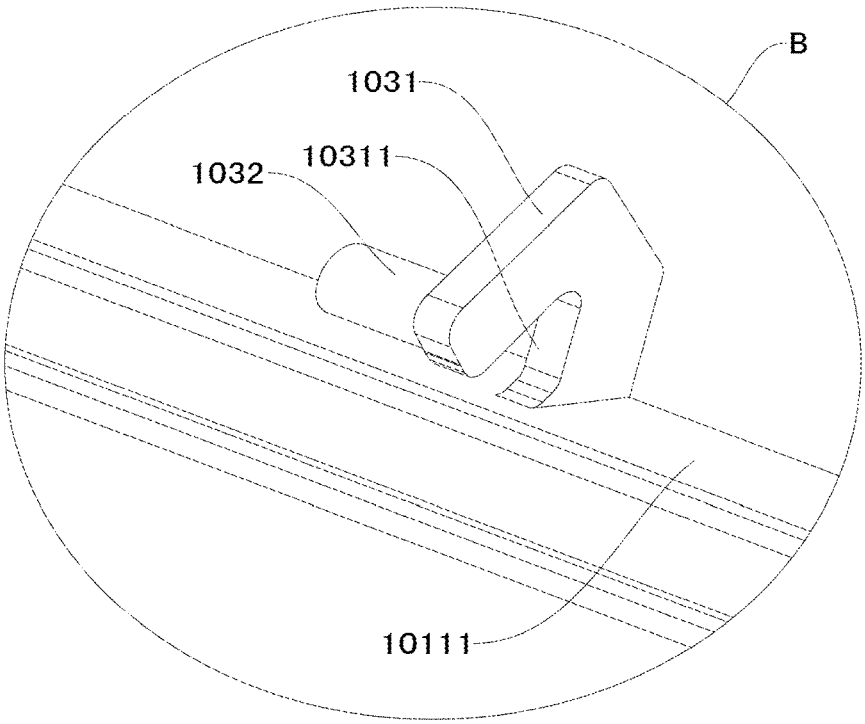
FIG. 7 is an enlarged view of region B in FIG. 5.

Advantageously, as shown in FIGS. 3 and 6-7, a first anti-collision groove 10311 is formed in the first support 1031, a second anti-collision groove 10331 is formed in the second support 1033, and a third anti-collision groove 10341 is formed in the third support 1034. In the open position, a third part of the cover plate 102 is engaged within the first anti-collision groove 10311, a fourth part of the cover plate 102 is engaged within the second anti-collision groove 10331, and a fifth part of the cover plate 102 is engaged within the third anti-collision groove 10341. The cover plate 102 may be spaced apart from a wall of the first anti-collision groove 10311, a wall of the second anti-collision groove 10331, and a wall of the third anti-collision groove 10341. The cover plate 102 may also be abutted against the wall of the first anti-collision groove 10311, the wall of the second anti-collision groove 10331, and the wall of the third anti-collision groove 10341, such that the cover plate 102 cannot continue to pivot, and consequently an angle of the cover plate 102 when being opened may be fixed, i.e. the cover plate 102 in the open position may be kept in a fixed position.

As shown in FIGS. 3-5 and 13-14, an upper portion 101611 of the first part 10161 of the front surface 1016 of the body 101 is recessed backwardly with respect to a remaining portion 101612 of the first part 10161 of the front surface 1016 of the body 101, and a receiving space 1028 is defined between the cover plate 102 and the upper portion 101611 of the first part 10161 of the front surface 1016 of the body 101.

Thus, when the first snapping member 1012 and the second snapping member 1023 fail, i.e. the second snapping member 1023 cannot be detached from the first snapping member 1012, a finger of a user may be put into the receiving space 1028 with an open upper end from above, so as to open the cover plate 102 forcedly. An up-down direction is as indicated by an arrow H in FIG. 1.

In other words, an upper part of the rear wall 10131 of the recess 1013 is recessed backwardly with respect to a remaining part of the rear wall 10131 of the recess 1013, and the receiving space 1028 is formed between the cover plate 102 and the upper part of the rear wall 10131 of the recess 1013. In other words, when the cover plate 102 is in the closed position, a distance between the cover plate 102 and the upper part of the rear wall 10131 of the recess 1013 in the front-rear direction is greater than a distance between the cover plate 102 and the remaining part of the rear wall 10131 of the recess 1013 in the front-rear direction. Since the upper end of the recess 1013 is open, the upper end of the receiving space 1028 is also open.

It would be appreciated by those skilled in the art that the microwave cooking device 1 further includes a door 40 mounted on the shell 20. A receiving groove 41 for receiving the ventilation grid assembly 10 is formed in a rear surface of the door 40.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A microwave cooking device, comprising:

a shell defining an air inlet and an air outlet therein;

a filter screen disposed at the air outlet; and a ventilation grid assembly comprising:

a body defining a through hole therein and disposed on an outer surface of the shell, the through hole being opposite to the filter screen;

a cover plate disposed on the body and moveable between an open position where the through hole is opened by the cover plate and a closed position where the through hole is closed by the cover plate, wherein the cover plate defines a positioning hole and a snapping groove therein;

a first support disposed at a bottom wall of the through hole;

a positioning column defining a first end disposed on the first support and a second end which is a free end and is fitted within the positioning hole, the cover plate being rotatable relative to the second end of the positioning column;

a second support and a third support disposed at the bottom wall of the through hole and spaced apart from each other; and a positioning pin defining a first end disposed on the second support and a second end disposed on the third support, and snap-fitted within the snapping groove, the cover plate being rotatable relative to the positioning pin.

2. The microwave cooking device according to claim 1, wherein the cover plate is pivotably disposed on the body between the open position and the closed position.

3. The microwave cooking device according to claim 1, wherein an edge of the through hole is located outside an edge of the filter screen.

4. The microwave cooking device according to claim 1, wherein the snapping groove has a first snapping face and a second snapping face opposite to each other, and a distance between the first snapping face and the second snapping face is first decreased and then increased in a direction away from an opening of the snapping groove.

5. The microwave cooking device according to claim 1, wherein a first snapping member is disposed on the body, and a second snapping member is disposed on the cover plate, snap-fitted with the first snapping member in the closed position and detached from the first snapping member in the open position.

6. The microwave cooking device according to claim 5, wherein the first snapping member comprises a first elastic snapping arm having a first snapping hook and a second elastic snapping arm having a second snapping hook which define a receiving chamber therebetween, and the second snapping member has a third snapping hook and a fourth snapping hook, in which in the closed position, a part of the second snapping member is received in the receiving chamber, the third snapping hook is snap-fitted with the first snapping hook, and the fourth snapping hook is snap-fitted with the second snapping hook.

7. The microwave cooking device according to claim 5, wherein a first part of a front surface of the body is located right above the through hole, opposite to an upper portion of the cover plate in the closed position, and recessed backwardly with respect to a remaining part of the front surface of the body, and the first snapping member is disposed on the first part of the front surface of the body.

8. The microwave cooking device according to claim 7, wherein a first protruding rib is disposed at a left side wall of the through hole, a second protruding rib is disposed at a right side wall of the through hole, a front surface of the first protruding rib and a front surface of the second protruding rib are located behind the remaining part of the front surface of the body, in which in the closed position, a left portion of the cover plate is abutted against the first protruding rib and a right portion of the cover plate is abutted against the second protruding rib, and the cover plate is spaced apart from the first part of the front surface of the body in a front-rear direction.

9. The microwave cooking device according to claim 8, wherein in the closed position, an upper edge of the first protruding rib and an upper edge of the second protruding rib are adjacent to an upper edge of the cover plate.

10. The microwave cooking device according to claim 7, wherein a first limiting groove is formed in a lower portion of the first protruding rib or formed between the first protruding rib and the bottom wall of the through hole, a second limiting groove is formed in a lower portion of the second protruding rib or formed between the second protruding rib and the bottom wall of the through hole, in which in the open position, a first part of the cover plate is engaged within the first limiting groove and abutted against a top wall of the first limiting groove, and a second part of the cover plate is engaged within the second limiting groove and abutted against a top wall of the second limiting groove.

11. The microwave cooking device according to claim 8, wherein a first limiting groove is formed in a lower portion of the first protruding rib or formed between the first protruding rib and the bottom wall of the through hole, a second limiting groove is formed in a lower portion of the second protruding rib or formed between the second protruding rib and the bottom wall of the through hole, in which in the open position, a first part of the cover plate is engaged within the first limiting groove and abutted against a top wall of the first limiting groove, and a second part of the cover plate is engaged within the second limiting groove and abutted against a top wall of the second limiting groove.

12. The microwave cooking device according to claim 7, wherein an upper portion of the first part of the front surface of the body is recessed backwardly with respect to a remaining portion of the first part of the front surface of the body, and defines a receiving space with the cover plate.

13. The microwave cooking device according to claim 8, wherein an upper portion of the first part of the front surface of the body is recessed backwardly with respect to a remaining portion of the first part of the front surface of the body, and defines a receiving space with the cover plate.

14. The microwave cooking device according to claim 9, wherein an upper portion of the first part of the front surface of the body is recessed backwardly with respect to a remaining portion of the first part of the front surface of the body, and defines a receiving space with the cover plate.

15. The microwave cooking device according to claim 10, wherein an upper portion of the first part of the front surface of the body is recessed backwardly with respect to a remaining portion of the first part of the front surface of the body, and defines a receiving space with the cover plate.

16. The microwave cooking device according to claim 1, wherein the positioning pin is static relative to the body.

* * * * *